United States Patent [19]

Francis et al.

[11] Patent Number: 4,608,809

[45] Date of Patent: Sep. 2, 1986

[54] METHOD AND APPARATUS FOR FILLING AND PACKAGING A FLOWABLE PRODUCT

[75] Inventors: Ronald R. Francis, Hamilton Square, N.J.; Martin Mueller, Wonder Lake, Ill.

[73] Assignee: General Foods Corporation, White Plains, N.Y.

[21] Appl. No.: 669,545

[22] Filed: Nov. 8, 1984

[51] Int. Cl.[4] ..... B65B 7/28

[52] U.S. Cl. ..... 53/471; 53/486; 53/297; 53/330

[58] Field of Search ..... 53/266 R, 267, 282, 53/285, 287, 300, 307, 366, 471, 478, 297, 319, 328, 330, 353, 365, 486, 489

[56] References Cited

U.S. PATENT DOCUMENTS

| | | | |
|---|---|---|---|
| 1,980,361 | 11/1934 | Spear | 53/287 X |
| 2,106,893 | 2/1938 | Krein | 53/440 X |
| 2,695,125 | 11/1954 | Bowen | 414/126 X |
| 3,267,971 | 7/1963 | Mueller . | |
| 3,487,622 | 1/1970 | Mueller | 53/282 |
| 3,564,812 | 10/1972 | Mueller et al. . | |
| 3,659,744 | 5/1972 | Byrd et al. | 221/1 |
| 3,807,909 | 4/1974 | St. Clair | 417/517 |
| 3,865,281 | 2/1975 | Byrd et al. | 222/252 |
| 3,976,196 | 8/1976 | Mueller | 206/526 |
| 4,323,168 | 4/1982 | Callahan | 414/129 X |
| 4,335,987 | 6/1982 | Laxo | 414/129 X |
| 4,489,537 | 12/1984 | Gordon et al. | 53/281 X |

*Primary Examiner*—John Sipos
*Assistant Examiner*—Steven P. Weihrouch
*Attorney, Agent, or Firm*—Thomas R. Savoie; Thomas A. Marcoux; Daniel J. Donovan

[57] ABSTRACT

The apparatus incorporates a conveyor having a generally horizontal upper run which includes container receiving and supporting apertures, at a first station. At a second station along the conveyor path, the containers are each filled with a predetermined amount of a flowable product which is dispensed into each of the containers during relative vertical separating movement of a filler nozzle with respect to each container. Thereafter, each of the product-filled containers is conducted to a third station along the conveyor path wherein a closure fitment is positioned within the opening of the filled conical container. At a fourth station along the conveyor path, a crimping device mechanically crimps the upper edge of the container about an upturned annular flange of the closure fitment to thereby form a mechanical connection between the closure fitment and the conical container. The flange of the closure fitment is sealed, to the container to form a liquid-tight sealed packaging container structure.

27 Claims, 13 Drawing Figures

METHOD AND APPARATUS FOR FILLING AND PACKAGING A FLOWABLE PRODUCT

BACKGROUND OF THE INVENTION

1. Field of the Invention

This invention generally relates to a packaging apparatus and method, more particularly to an apparatus and method for filling a flowable product into an open-topped container, positioning a closure fitment into the container through its open top, crimping or folding a lip of the container over a portion of the fitment, and sealing the fitment to the folded lip of the container in order to form a sealed packaging and dispensing container for a flowable product. The invention is particularly suitable for filling and assembling sealed packaging and dispensing containers for soft ice cream and the like.

In general, although not limited thereto, the packaging apparatus and method according to this invention is adapted for application in connection with the packaging of soft ice cream wherein containers, preferably in the configuration of upwardly open cones, are individually tranferred from a stack of a plurality of nested cones onto a conveyor that transports the cones along a predetermined horizontal movement path. During such conveyance along the conveyor path, each cone is indexed to sequential processing stations, whereat each is filled with flowable product, has a closure or extrusion fitment positioned therewithin above the filled flowable product, and has the fitment mechanically fastened to the cones by crimping and energy sealing so as to produce a sealed package that is essentially liquid-tight and suitable for marketing to and use by consumers.

2. Description of the Prior Art

Numerous types of apparatus structures and methods are presently known and employed in packaging technology for filling and sealing of flowable products into various kinds of containers. None of the packaging equipment employed heretofore contemplate the provision of a novel and unique apparatus and method for effecting high-speed filling and packaging of flowable products, such as soft ice cream, sometimes referred to as soft-serve ice cream, into sealable containers. The present invention provides a method of enhancing efficiency, while concurrently avoiding the need for complex and expensive equipment in order to render the entire packaging procedure extremely economical. With respect to the different packaging structures and methods which have been developed heretofore, particularly those concerned with the filling and packaging of liquid or semi-solid, flowable products into sealable containers, none of these combine all of the advantageous features of the inventive packaging apparatus and method.

Mueller et al U.S. Pat. No. 3,564,812 describes a packaging apparatus and process in which a plurality of containers are continuously deposited in sequential steps on a conveyor from a container stacking arrangement which is located above the conveyor. Such containers are thereafter filled with a flowable product by a filling device and subsequently are covered with a web of transparent film that is thereafter severed to form individual container caps. Byrd et al U.S. Pat. No. 3,659,744 describes a conveyor system wherein frusto-conical cups are deposited onto a conveyor from a vertical cup-stacking arrangement. The deposited cups are filled with a flowable product and, at a subsequent station along the conveyor path, covers are applied to the filled containers. Mueller U.S. Pat. No. 3,976,196 describes a conveyor arrangement in which cups of a substantially frusto-conical configuration are filled with a flowable product, and subsequently a covering is applied thereto from a continuous web of film material, such web then being severed in order to form sealed packaging containers.

Mueller U.S. Pat. No. 3,267,971, St. Clair U.S. Pat. No. 3,807,909 and Byrd et al U.S. Pat. No. 3,865,281 each describe a different type of filling system that incorporates dispensing pumps and valves for accurately metering flowable product into containers which are adapted to be transported along a predetermined path by conveyor systems of the types illustrated and described in these patents.

These patents do not relate to the filling of containers of the type described herein with a flowable product such as soft-serve ice cream in a simple, rapid and efficient manner as contemplated by the inventive apparatus and method.

The present invention has been able to attain an important result of being able to fill, assemble and seal containers for flowable products, such as soft ice cream, which containers can be readily squeezed to extrude or dispense the product through an orifice in the closure fitment that is assembled to the container portion of the filled, assembled and sealed package. These containers are generally non-rigid, readily collapsible cone-shaped structures. This type of packaging for flowable products such as soft ice cream is believed to possess considerable appeal to consumers inasmuch as the resulting package is suitable for ready storage in home freezers and easy dispensing of soft-serve ice cream portions for neat and convenient consumption by consumers. Heretofore, packaging technology has not provided a satisfactory and economical means for filling, assembling and sealing such a package in a rapid and effiecient manner.

SUMMARY OF THE INVENTION

Accordingly, in order to obviate or ameliorate the limitations and drawbacks of prior packaging lines and methods, especially those employed in the packaging of flowable products, the present invention contemplates the provision of a packaging system that implements, in sequential steps and at various operating stations, the rapid and precise filling of a container with a soft ice cream or the like, the subsequent assembling of the container with a closure and extrusion fitment, and the sealing of the fitment to the container. In an important aspect of the invention, the containers are made of a readily foldable material, the closure and extrusion fitment is positioned within the container at a location spaced below the open-end edge or mouth of the container, and the open-end edge is then folded over and sealed onto the fitment.

It is accordingly a general object of the present invention to provide an improved filling, assembling and sealing apparatus and method that is especially suitable for use in packaging flowable products.

Another object of this invention is to provide an improved packaging apparatus and method for filling, assembling and sealing a package that includes a collapsible cone-shaped container and a semi-rigid extrusion fitment inserted into and sealed onto the open end of the container.

Another object of the present invention is to provide a novel packaging apparatus for the rapid and efficient filling and sealing of containers for a flowable product.

Another object of this invention is to provide a packaging apparatus of the type described in which packaging containers for a flowable product are filled, closed and sealed in a sequence of process steps in a simple, in-line operation.

Another object of the present invention is to provide a method of packaging a flowable product in sealed containers by utilizing the packaging apparatus of this invention.

These and other objects of the present invention will be apparent from the following description of an exemplary embodiment of an apparatus for packaging a flowable product, such as soft ice cream, in a sealed container incorporating a closure fitment through which the product may be easily and conveniently dispensed or extruded, taken in conjunction with the accompanying drawings, wherein.

DETAIL OF THE DESCRIPTION

Figure 1:
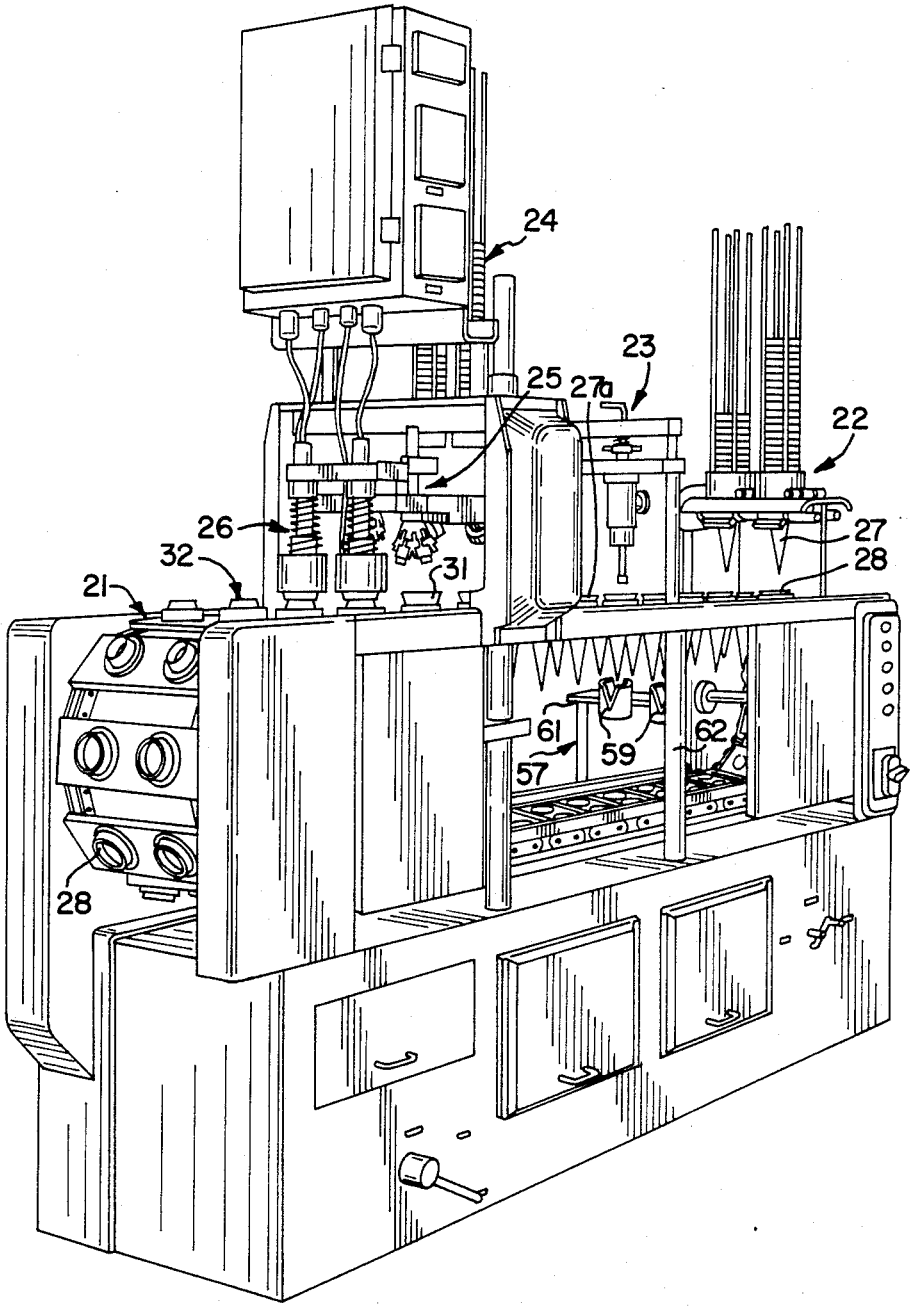
FIG. 1 is a perspective view of the illustrated filling, assembling and sealing apparatus according to this invention.
Figure 2:
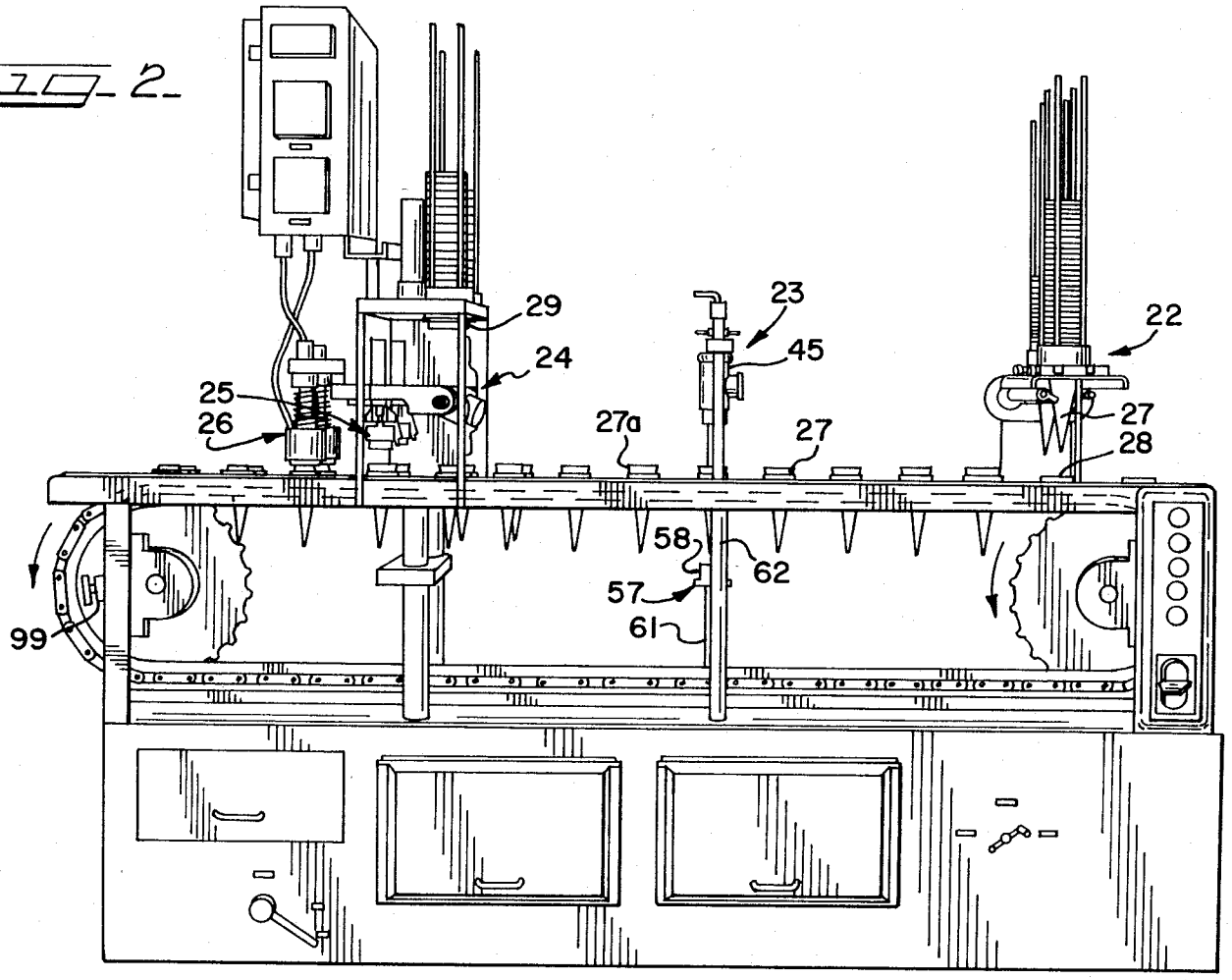
FIG. 2 is a front perspective view of the apparatus illustrated in FIG. 1.

The apparatus, as generally illustrated in FIGS. 1 and 2, includes a conveyor assembly having a generally horizontal upper run generally designated as 21, a container dispensing station having a dispensing assembly generally designated as 22, a flowable product filler station having a filler assembly generally designated as 23, a fitment insertion station having an insertion assembly generally designated as 24, a crimping station having a crimping assembly generally designated as 25, and a sealing station having an energy sealing assembly generally designated as 26. While the drawings illustrate a two-lane apparatus, it is to be understood that any number of transversely adjacent lanes may be chosen, within the usual limits of floor space availability and practical maximum fixture sizes and weights.

The apparatus operates, in timed sequence, such that the container dispensing assembly 22 deposits an empty container 27 into a container receiving and supporting apperture 28 of the conveyor upper run 21, which intermittently conveys or indexes the empty container 27 to each of the remaining stations. Each container 27 is first indexed to the filler assembly 23 at which flowable product is filled into the container 27 to provide a filled container **27*a*. Next, a closure fitment 29 that permits the consumer to extrude flowable product therethrough is positioned into the open mouth of the filled container 27*a* at the insertion station 24. At the crimping station 25, a lip portion 31 of the filled container 27*a* is folded over the fitment 29. Thereafter, this folded or crimped lip portion 31 is sealed to the fitment 29 in order to provide a filled and assembled completed package generally designated as 32. Packages 32 are removed from the conveyor assembly in any convenient manner, such as by dropping to a product collector (not shown) downstream of the sealing station 26**.

Figure 4:
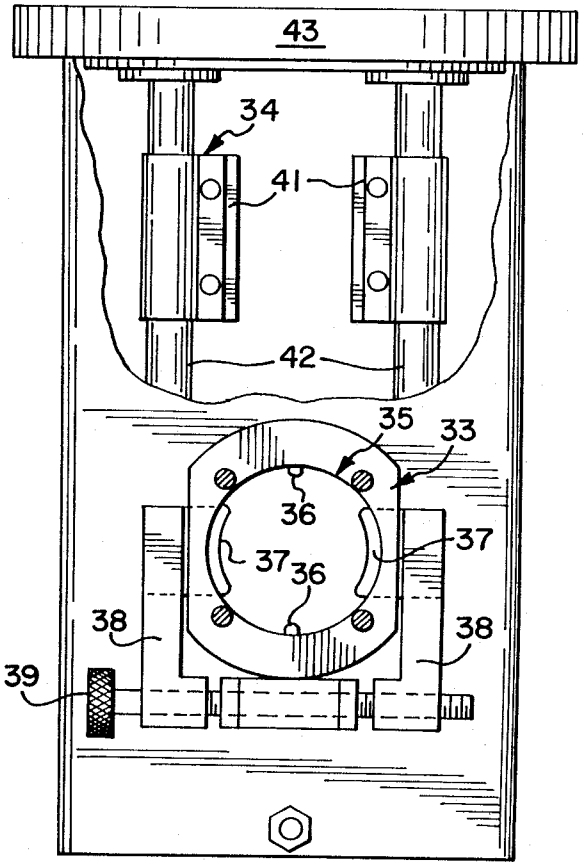
FIG. 4 is top plan view, partially cut away, of the container dispensing station illustrated in FIG. 3.
Figure 3:
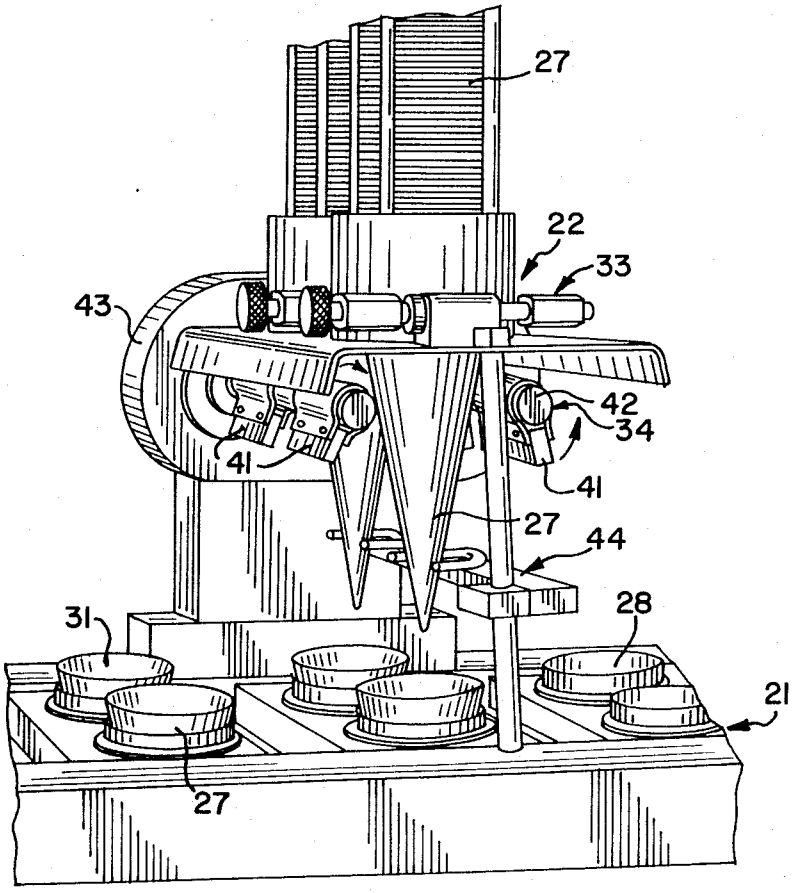
FIG. 3 is a perspective view of the preferred container dispensing station.

As more fully illustrated in FIGS. 3 and 4, the container dispensing assembly 22 supports a supply of nested empty containers 27 such that the lowermost nested container 27 is positioned above one of the container receiving and supporting appertures 28. Dispensing station 22 includes a container support assembly generally designated 33 and a container denester assembly generally designated 34.

Container support assembly 33 includes an obstructing opening 35 that is sized and shaped so that at least portions thereof engage the outside surface, typically the lip 31, of the lowermost nested empty container 27 in order to support the nested containers while still permitting passage therethrough of the lowermost container 27 when a generally downwardly directed force is applied thereto. In the illustrated embodiment, such obstructing opening 35 includes a plurality of inwardly directed projections that define obstructing portions of the opening 35. Various inwardly spaced obstructions could be provided. Those illustrated include oppositely positioned pins 36 and generally oppositely positioned adjustable brackets 37, each of which preferably has a generally arcuate edge as illustrated. The illustrated means for imparting adjustability to the brackets 37 includes threadedly mounted arms 38 which move the brackets 37 either inwardly or outwardly when a threaded rod 39 is rotated.

Denester assembly 34 includes counter-rotating pads 41. The illustrated means for effecting counter-rotation of the pads 41 includes rotatable shafts 42 that are driven by suitable means, typically an appropriate gear train that runs off of the main drive mechanism of the apparatus (not shown). For example, complementary gears may be mounted to the respective rotatable shafts 42 at a location within gear housing 43, such gears (not shown) being driven by a bevel gear assembly or the like (not shown) such that the counter-rotating pads 41 are in precise rotational alignment with one another.

In operation, the rotationally aligned counter-rotating pads 41 of the container dispensing assembly 22 engage generally opposing locations on the lowermost nested container 27 and urge such container 27 downwardly in opposition to the support thereof that is provided by the obstructive opening 35. This combination of functions causes a slight bending of the lip portion 31 of the bottom container 27 as the lip portion 31 is pulled downwardly through the obstructive opening 35. Accurate dropping of each empty container 27 into one of the container receiving and supporting appertures 28 can be facilitated by providing an appropriate arrangement such as the illustrated guiding assembly 44.

Convenient and efficient timing of the movement of the conveyor upper run 21 with respect to this delivery of each empty container 27 by the container dispensing assembly 22 is achieved by providing substantially constant counter-rotation of the pads 41 such that one complete rotation of each pad 41 corresponds to one complete index of the entire apparatus. During each index, each apperture 28 moves upstream through a distance equal to the longitudinal spacing between consecutive appertures 28.

Figure 6:
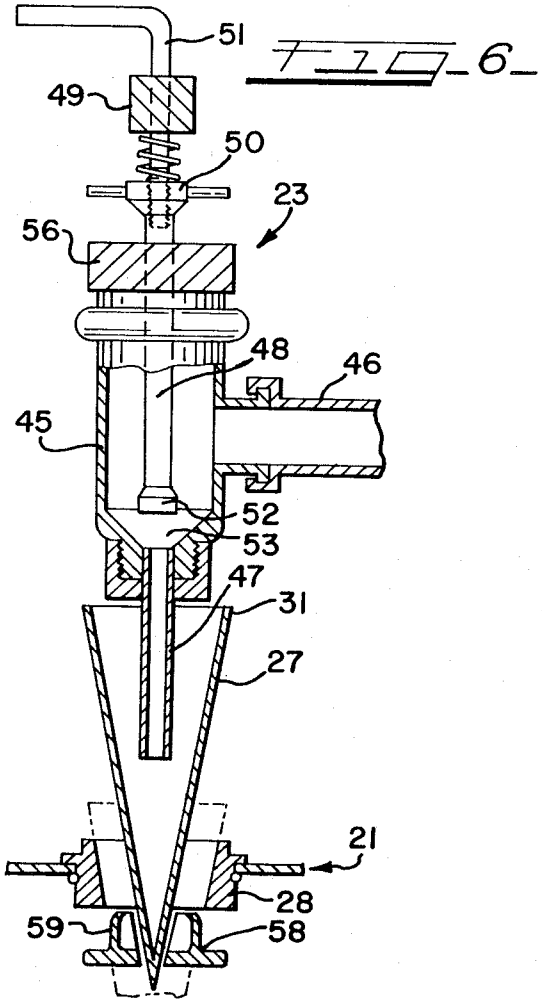
FIG. 6 is an elevational view, partially in longitudinal cross-section, of the filling station illustrated in FIG. 5.
Figure 5:
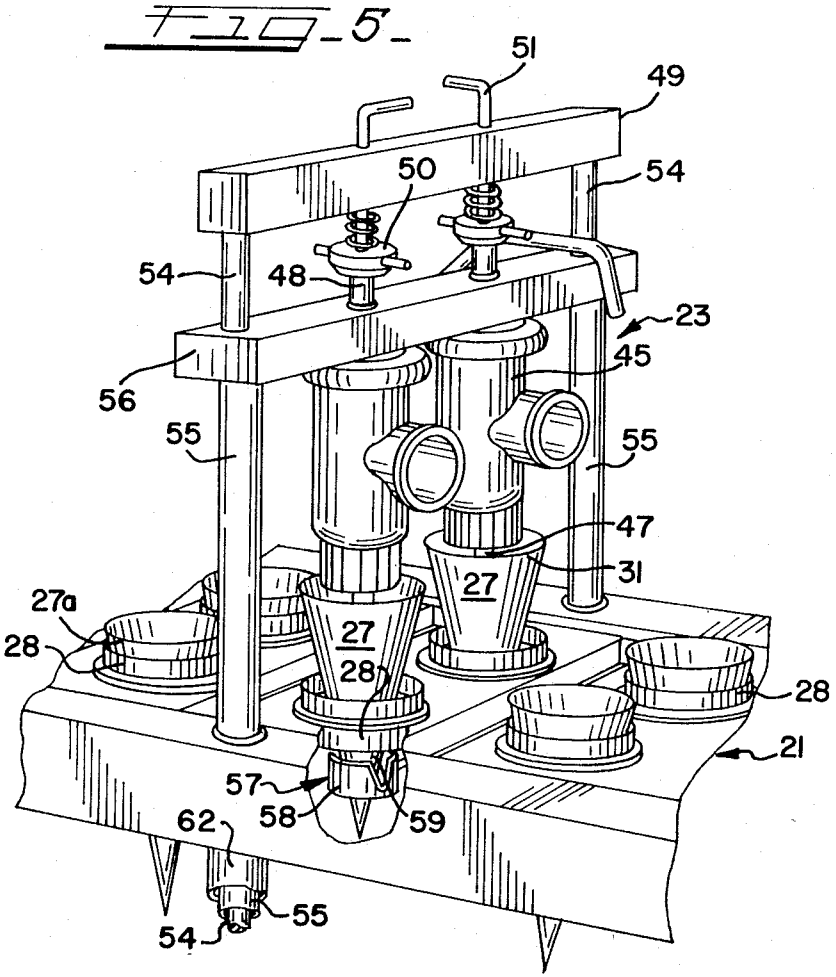
FIG. 5 is a perspective view, partially cut away, of the preferred flowable product filling station.

Flowable product filler assembly 23 is shown in more detail in FIGS. 5 and 6. A filling valve 45 is mounted above and in general alignment with a container receiving and supporting apperture 28 that has been indexed thereunder, such alignment being accomplished by including appropriate means (not shown) for timing the operation of each filling valve 45 with the indexing movement pattern of the conveyor run 21 such that each filling operation is carried out when an apperture 28 is generally coaxially positioned under each filling valve 45.

Each filling valve 45 is connected through a suitable conduit 46, to a substantially constant supply of flowable product such as soft ice cream. The flowable product exits each filling valve 45 through a depending discharge nozzle 47, which is designed to enter and protrude to a substantial extent into a container 27 in order to facilitate "bottom-up" filling of each container 27. Various approaches can be used achieve "bottom-up" filling, which is an important aspect of filling a flowable product in order to minimize or eliminate formation of air pockets within the filled flowable product. This is especially important when the container being filled has a portion that has a substantially narrower cross-section than other portions of the container, such as the illustrated conically-shaped containers.

With "bottom-up" filling, according to this invention, the initial stage of filling each container 27 is carried out when the nozzle 47 projects a substantial distance into the container 27 and relatively closely spaced from the narrowed, apical portion thereof. As filling proceeds, and before the product being filled contacts the protruding end of the discharge nozzle 47, relative movement begins between the discharge nozzle 47 and the container 27 such that the distanced between them increases.

Preferably, for conically-shaped containers, this relative movement (putting aside for now any possible variation in the speed at which flowable product is delivered out of the discharge nozzle 47) preferably quickly reaches its maximum speed and thereafter decelerates until the flowable product is filled to the desired height. By this approach, the volume of flowable product flowing into respective cross-sections of the conical volume of the container 27 will increase during the period of such decelerating relative movement since the nozzle 47 will remain at each cross-section, during deceleration, for increasing lengths of time, thereby providing an increasing volume flow to fill the increasingly sized cross-sections of the conical volume.

If possible this relative movement preferably includes exceptionally rapid initial acceleration in order to minimize the likelihood of having flowable product splash out of the container 27. Such splashing occurs when flowable product fills the narrow bottom of the container 27 so rapidly that it engages the bottom of the discharge nozzle 47 and spurts thereabove through the relatively narrow opening between the bottom of the discharge nozzle 47 and the walls of the container 27 at a relatively narrow cross-sectional location thereof.

This preferred rapid acceleration and gradual deceleration of the relative movement between the discharge nozzle 47 and the container 27 can be achieved by upward movement of the filling valve 45, downward movement of the container 27, or a combination of both such movements. The arrangement illustrated in FIGS. 1, 2, 5 and 6 provides a combination of upward movement of each filling valve 45 and downward movement of each container 27, and each filling valve 45 includes an arrangement for gradually increasing the flow of product therethrough while the filling valve 45 moves upwardly. In the illustrated embodiment, the following sequence of steps is performed.

By a suitable mechanism, such as a cam system driven by the main drive shaft of the apparatus (not shown), pneumatic cylinders or the like, each valve 45 is vertically movable, and a valve stem 48 is vertically movable within each filling valve 45. Each valve stem 48 extends upwardly out of its filling valve 45 and has a threaded cap 50 that is mounted to a support bar 49 by means of a threaded rod 51. Rotation of the threaded rod 51 relative to the cap 50 provides fine tuning adjustment of the spacing between the support bar 49 and the cap 50 of the valve stem 48 to thereby precisely adjust the engagement of a plunger 52 on the bottom of each valve stem 48 with a seat 53 of each filling valve 45. Accordingly, when a shaft 54 that supports the bar 49 is raised with respect to a coaxial shaft 55 that supports a bar 56 to which the filling valves 45 are mounted, the valve stem 48 is raised within the valve 45, and the plunger 52 is moved away from the seat 53 to thereby effect an opening of the filling valve 45. When shaft 54 moves downwardly into coaxial shaft 55, plunger 52 moves downwardly into engagement with seat 53 in order to thereby close the filling valve 45.

Also provided in the embodiment illustrated in FIGS. 1, 2, 5 and 6 is a lifter mechanism, generally designated 57, for raising container 27 out of the apperture 58 and for lowering filled container **27*a* into the apperture 28. Lifter mechanism 57 includes a holder 58 positioned below and generally coaxial with each apperture 28 when it is indexed to and positioned at the filler assembly 23. Each holder 58 closely receives a container 27. Preferably, each holder 58 includes a generally V-shaped passageway 59 to facilitate longitudinal passage of containers 27 into and out of each holder 58 and to reduce the stroke length required of the lifter mechanism 57, which further includes appropriate support structure, such as the illustrated vertical shaft and mounting bracket assembly 61**.

The illustrated flowable product filler assembly 23 operates as follows. An apperture 28 having a container 27 is indexed to be generally coaxial with the discharge nozzle 47 and the holder 58. Lifter mechanism 57 is actuated by appropriate means in order to raise the holder 58 to thereby lift the container 27 out of the apperture 28 to a position generally illustrated in FIGS. 5 and 6. At substantially the same time, a suitable drive mechanism moves the coaxial shaft 55 downwardly, for example within a stationary shaft 62. When these movements are completed, the tip of nozzle 47 is positioned at its lowermost location within the container 27.

Next, the drive mechanism begins to slide the shaft 54 within coaxial shaft 55 to thereby open the filling valve 49 to permit flowable product to pass out of discharge nozzle 47 and into the bottom of the container 27. This movement continues, and plunger 52 increasingly moves away from the tapered seat 53 which, in turn, gradually increases the size of the valve opening to increase the volume rate of product flow out of the discharge nozzle 47. Generally simultaneously, the lifter mechanism 57 moves downwardly until each container rests within its apperture 28.

When container 27*a* has been filled to the desired level, the drive mechanism rapidly slides the shaft 54 into coaxial shaft 55 to thereby close the filling valve 45 by engaging the plunger 52 with its seat 53. At this stage, coaxial shaft 55 and shaft 54 are moved upwardly together so that the filling valve 45 is raised an appropriate distance above the lip portion 31 of the container 27. This upward movement insures that the tip of nozzle 47 is above and well clear of the container 27, while also providing an upward length of travel that is sufficient to break off any flowable product that is suspended between the tip of nozzle 47 and product of the filled container 27*a* before the conveyor run 21 indexes in the downstream direction.

Figure 8:
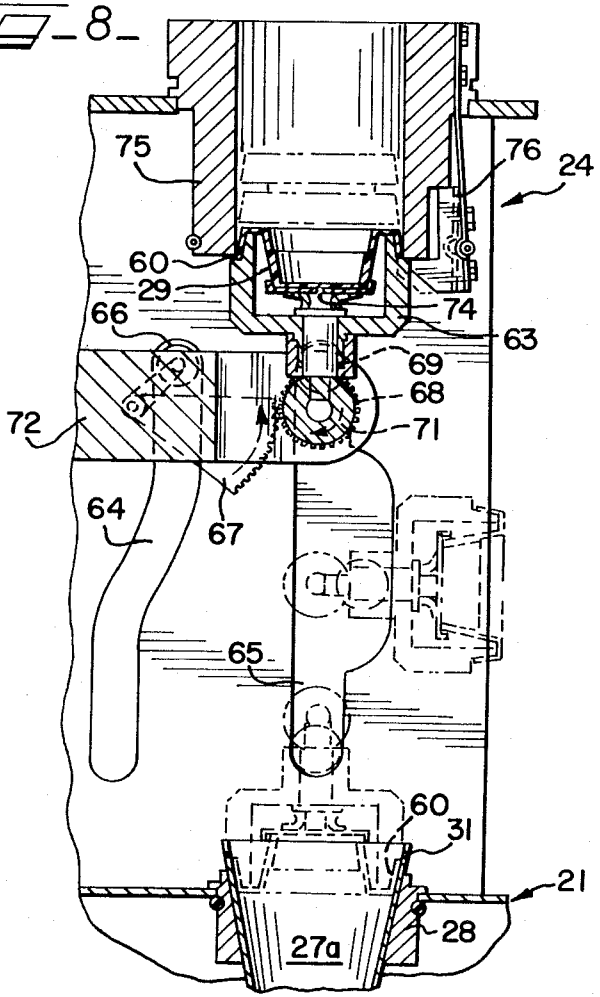
FIG. 8 is a longitudinal sectional view through the fitment insertion station, including phantom illustrations of various operative positions thereof.
Figure 7:
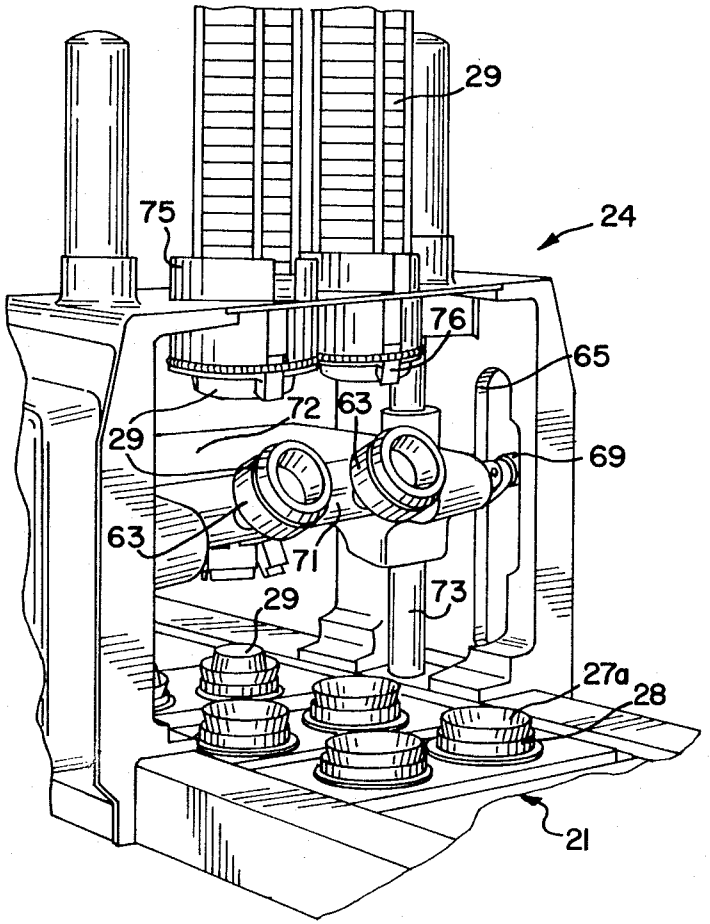
FIG. 7 is a perspective view of the closure fitment insertion station whereat a closure fitment is deposited into the open end of each container.

Fitment insertion assembly 24 is more particularly illustrated in FIGS. 7 and 8. A plurality of closure and extrusion fitments 29 are nested in a holder 55 in an essentially inverted orientation, the bottom one of which is accessible to a cup 63, which is rotatably mounted and driven between an upwardly directed orientation (illustrated in solid in FIG. 8) and a downwardly directed orientation (illustrated in phantom in FIG. 8). When in the upwardly directed orientation, the cup 63 removes the lowermost fitment 29 from its nested position and transports that fitment 29 to a location at which it is inserted within the filled container 27*a*. Such insertion of the fitment 29 into the filled container 27*a* is to a distance such that the free external peripheral edge 60 of the fitment 29 generally defines the lip portion 31 of the filled container 27*a*.

While various structures may be used for effecting this result, the illustrated structure includes a camming assembly having a driving cam path 64 and its cam follower 66 and an aligning cam path 65 and its cam follower 69. The camming assembly also includes a drive gear 67, a driven gear 68 that meshes therewith and that is secured to the cam follower 69. A driven gear 68 is also firmly secured to a driven rotatable shaft 71, onto which each cup 63 is securely mounted. Driven shaft 71 is rotatably mounted to a support 72, which is in turn secured to an appropriate drive assembly, such as one including the illustrated vertical shaft 73. Movement of the vertical shaft 73 downwardly from the position shown in FIG. 8 effects the movement of the cup 63 from the upwardly directed position to its downwardly directed position along the path illustrated in FIG. 8. Upward movement of the support 72 results in a reverse-direction tracking of this same path.

Most conveniently, the cup 63 includes a vacuum assembly for pulling a vacuum through a cup orifice 74 in order to engage a fitment 29, which vacuum is released when fitment insertion is completed. When the support 72 and the cup 63 initially move downwardly, the lowermost fitment 29 moves downwardly therewith, and the remainder of the stack of fitments 29 stay within the holder 75. The illustrated means for accomplishing this includes a plurality of spring clips 76 which are pushed outwardly with respect to the axis of the holder 75 when they are engaged by the cup 63. When cup 63 moves downwardly, each spring clip 76 rapidly moves generally inwardly and engages the next fitment 29 within the nest to thereby hold same and the remainder of the nest in place until the cup 63 returns to its uppermost position.

Crimping assembly 25 is provided in order to inwardly and downwardly fold the lip portion 31 of each filled container 27*a* over the peripheral edge 60 and onto an inner face 77 of each fitment 29. In the embodiment illustrated in FIGS. 9, 10 and 11, this crimping or folding of the lip portion 31 is achieved by its engagement with a plurality of crimping segments 78, the illustrated crimping segments combining, when closed, to define a generally circular structure.

Figure 9:
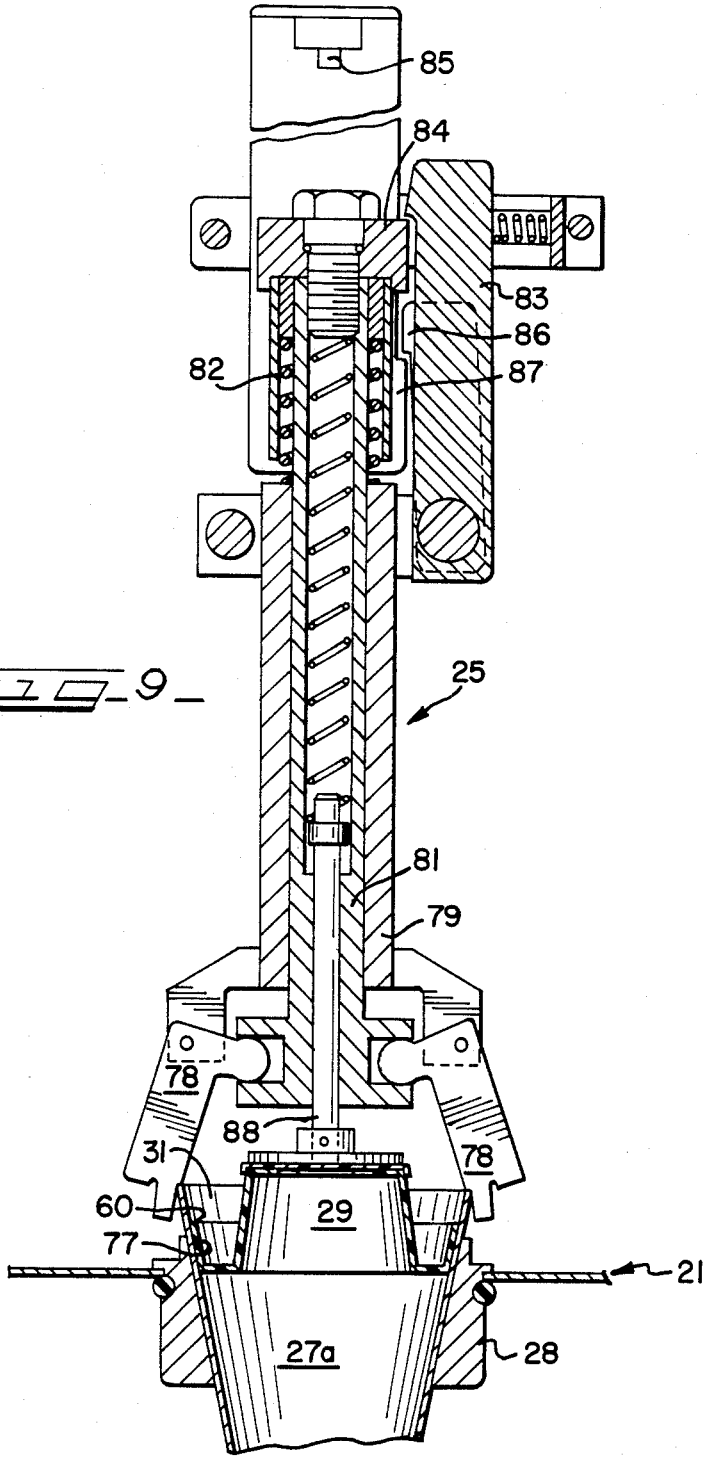
FIG. 9 is a longitudinal cross-section of the preferred crimping station, shown at its orientation immediately prior to crimping initiation.

Crimping segments 78 are open as illustrated in FIG. 9 when they first are positioned for engagement with the lip 31. Next, the crimping segments close to their generally circular configuration, thereby bending the lip 31 to the generally horizontal orientation thereof illustrated in FIG. 10. Thereafter, the generally closed crimping segments 78 move downwardly to thereby fold the lip portion 31 to a generally vertical orientation which substantially overlies the inner face 77 of the fitment 29. Then, the closed crimping segments 78 are raised to permit indexing movement of the crimped container and fitment assembly to the next downstream station having the sealing assembly 26.

This movement sequence of the crimping segments 78 may be accomplished by any suitable means, the illustrated means having been found to provide adequate and efficient operation in this regard. Each crimping segment 78 is rotatably mounted to a sleeve 79 and is in levered engagement with a shaft 81 slidably mounted within the sleeve 79 such that upward movement of the shaft 81 with respect to the sleeve 79 closes the crimping segments 78 and a downward movement of the shaft 81 with respect to the sleeve 79 opens the crimping segments 78.

With more particular reference to the orientation illustrated in FIG. 9, the crimping segments 78 are maintained in their open orientation in opposition to a compressed spring 82, which compression is maintained by the engagement of a latch 83 with a shaft mount 84. Loading to this orientation is facilitated by providing a stop 85 to limit upward movement of the shaft mount 84, such loading being carried out when the shaft mount 84 is at its uppermost orientation (not shown).

Figure 10:
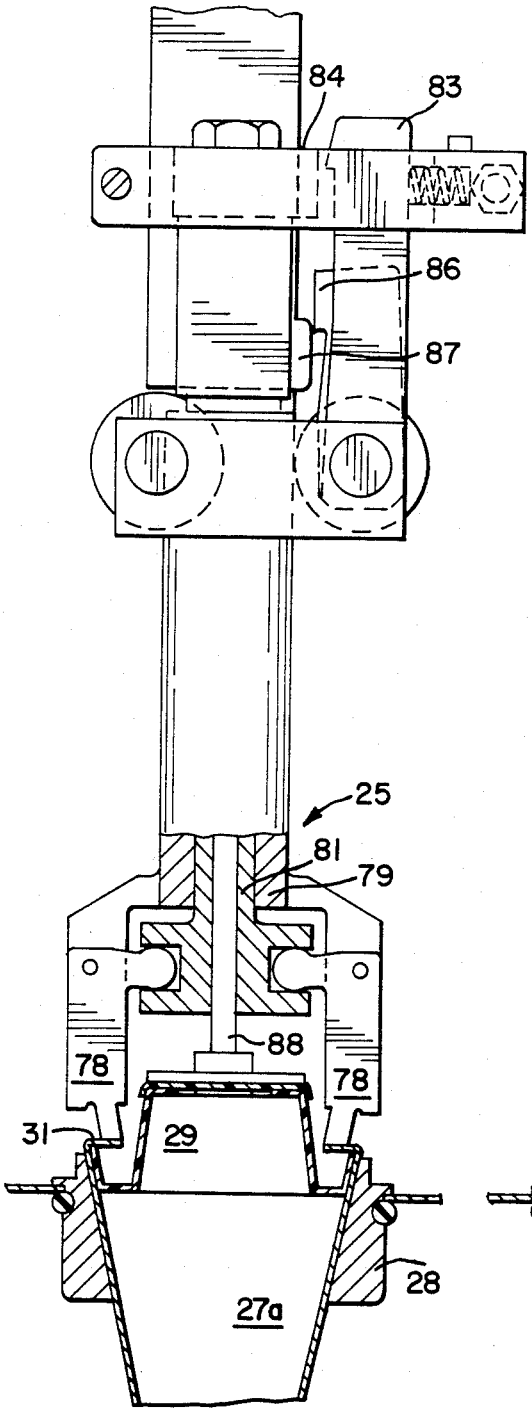
FIG. 10 is an elevational view, partially in cross-section, of the crimping station shown FIG. 9, illustrated after crimping has been initiated.
Figure 11:
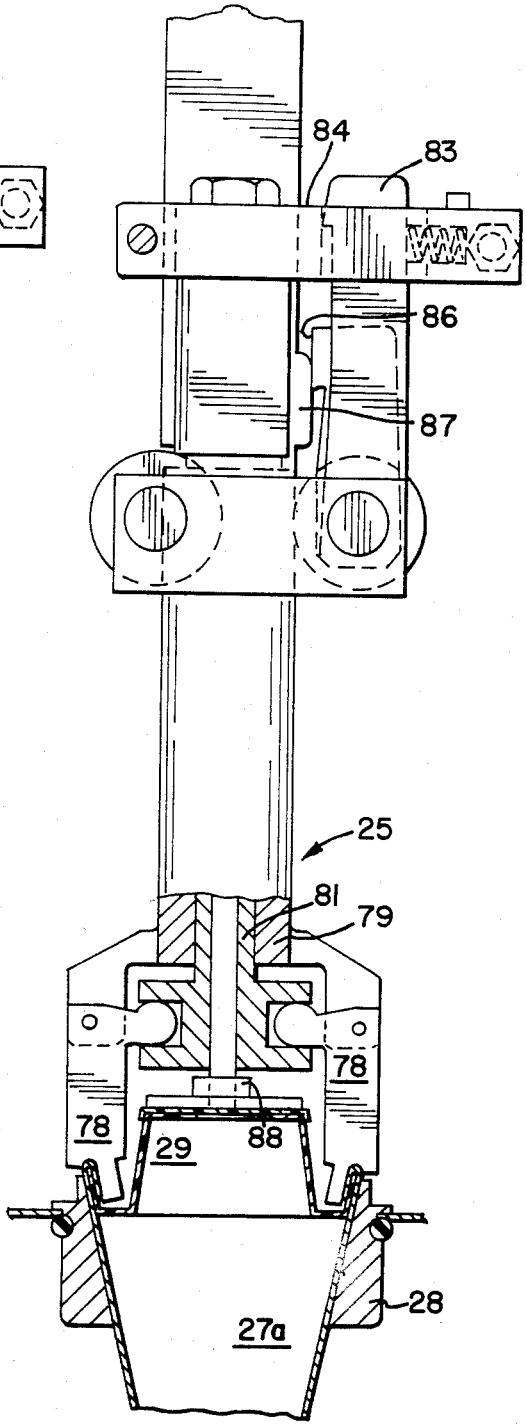
FIG. 11 is an elevational view, partially in cross-section, of the crimping station, shown after crimping has been completed and prior to withdrawal of the crimping assembly from the crimped package.
Figure 12:
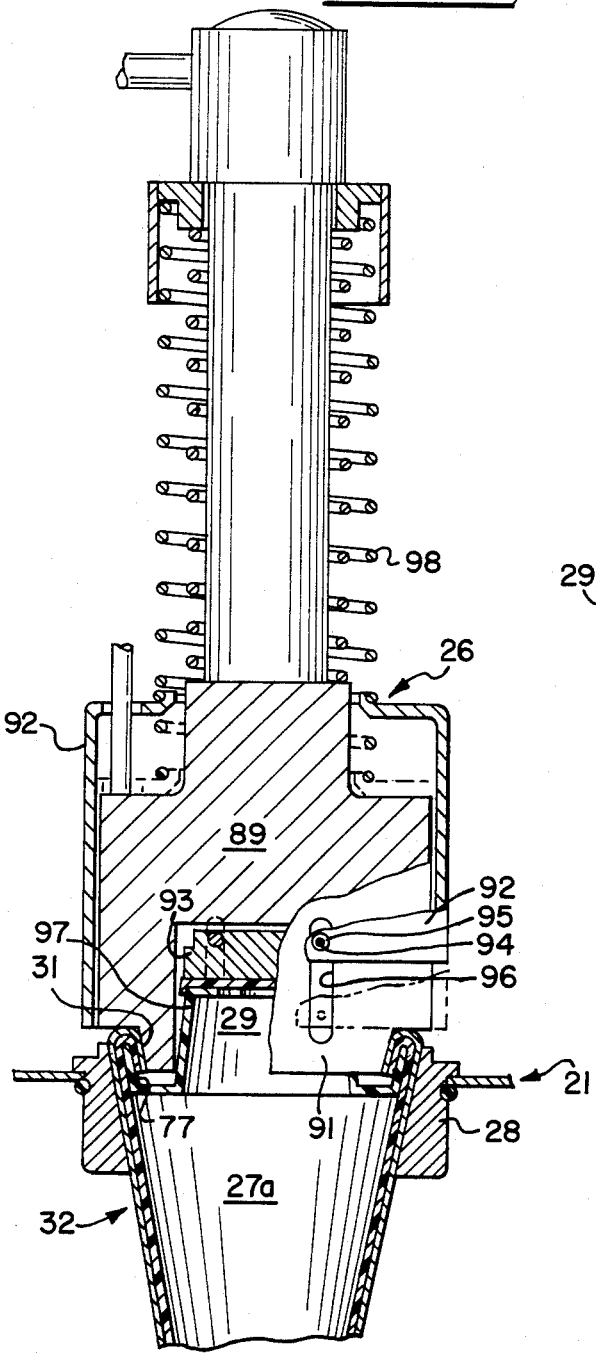
FIG. 12 is elevational view, partially in cross-section and partially cut away, of the preferred sealing station.

In FIG. 10, the latch 83 has been moved from the shaft mount 84, and the spring 82 has been released, which release permits the spring 82 to move the shaft mount 84 and the shaft 81 upwardly to effect the desired closing of the crimping segments 78. This disengagement of the latch 83 from the shaft mount 84 is triggered by the downward movement of the crimping assembly 25 until a trigger 86, which is rigidly mounted to the latch 83, engages and is moved generally outwardly by a stationary protrusion 87 that is mounted independently of the rest of the crimping assembly 25. This results in the generally horizontal folding of the lip portion 31.

Crimping assembly 25 continues to move downwardly while the crimping segments 78 are in this closed orientation in order to complete the crimping operation. Then, the crimping assembly 25 moves upwardly to clear the thus crimped fitment and container assembly, which is next indexed to the following station. Upward movement continues until the stop 85 is engaged and the assembly 25 is reloaded to its open orientation to permit downward movement and return to the FIG. 9 position. A spring-loaded plunger 88 may be provided to engage each fitment 29 in order to be assured that each fitment 29 is properly seated and substantially horizontally positioned within the filled container 27*a*.

Sealing assembly 26 applies appropriate sealing energy to achieve a secure joining of the crimped lip portion 31 of the filled container 27*a* to the inner face 77 of the fitment 29. The illustrated means for accomplishing this function is shown in FIG. 2, which illustrated sealing assembly 26 also includes a mechanism for ejecting fitments 29 from the sealing assembling 26.

Illustrated sealing assembly 26 includes a vertically movable sealer head 89, which has an annular bottom sealing lip 91 that is sized and structured so as to generally conform to the shape and size of the inner face 77 of the fitment 29. At the time that a container receiving and supporting apperture 28 is indexed to a position below and substantially coaxial with the annular bottom sealing lip 91, the sealing head 89 is displaced downwardly, typically by being driven off of the drive shaft (not shown) of the apparatus, until the annular bottom sealing lip 91 nests against the crimped lip portion 31 and exerts pressure thereon to tightly engage the folded over lip portion 31 with the inner face 77 of the fitment 29. At this stage, the sealing head 89 imparts sealing energy by well-known means such as the application of heat to the sealing lip 91 which effects heat sealing between the fitment lip portion 31 and the inner face 77.

Occasionally during the course of operation of the apparatus, a container 27 is not properly deposited by the dispensing assembly 22 within a particular container receiving and supporting apperture 28, with the result that only a fitment 29 is conveyed to the sealing assembly 26 Should this happen, then the sealing lip 91 will directly engage the fitment inner face 77 and will tend to hang up on the sealing lip 91 because it is partially melted thereonto, or the fitment 29 is mechanically jammed onto the sealing lip 91. The possible occurrence of this problem is increased because fitments 29 are typically of a very light weight that is inadequate to offset these hang-up forces. This problem is substantially eliminated by the illustrated embodiment having a knock-out assembly which includes a spring-loaded sleeve 92 and a knock-out plate 93 mounted thereonto. Mounting of the knock-out plate 93 to the sleeve 92 is accomplished by a pin 94, which is preferably generally U-shaped. Pin 94 is fed through two pairs of opposing holes 95 (only one hole 95 being shown) within the spring-loaded sleeve 92. Thus assembled pin 94 also passes through slots 96 of the sealer head 89.

In operation, when the sealer head 89 moves downwardly to engage a fitment 29, a raised central portion 97 of the fitment 29 engages and raises the knock-out plate 93. This raising movement is imparted, through the pin 94, to the sleeve 92, which thereby compresses a spring 98 to bias the knock-out plate 93 toward the downward direction Then, when the sealer head 89 is raised after completion of the sealing cycle, the knock-out plate 93 moves downwardly in order to exert a downward force on the raised central portion 97 and to eject the fitment 29 thereof, whether or not that fitment 29 is sealed to a filled container 27*a*.

The thus completed filled container and fitment package 32 is then conveyed along the upper conveyor run 21 for eventual discharge from the apperture 28. This discharge can, if desired, be assisted by suitable means, such as an ejector assembly 99 (FIG. 2) positioned at the discharge end of the conveyor, the ejector assembly 99 being reciprocable and being driven by suitable means run from or otherwise sequentially timed to the indexing sequence of the apparatus.

Figure 13:
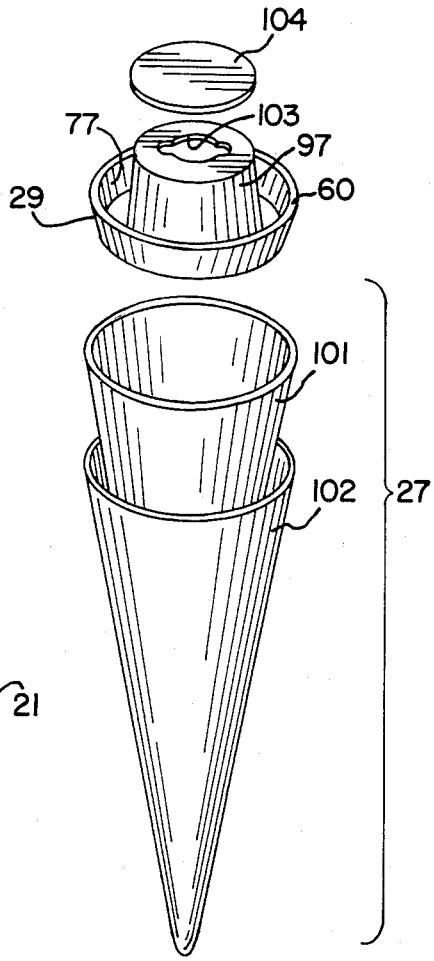
FIG. 13 is an exploded perspective view of the preferred container package that is filled, assembled, and sealed on the apparatus and according to the method of this invention.

FIG. 13 more fully illustrates the structure of the preferred products or packages that are assembled on the apparatus and according to the method of this invention. Illustrated container 27 is a collapsible cone-shaped assembly including an inner cone-shaped member 101 and an outer cone-shaped member 102 that are secured to one another in order to provide a liquid-impervious container 27. Outer member 102 may be made of an inexpensive material having acceptable hand feel, paper being an especially suitable material. Inner member 101 is made of a material that will be sealed by the sealer head 89 onto the fitment 29, the typical material therefor being a thermoplastic film. Container 27 is substantially flexible and may be readily collapsed by squeezing, or in essence, applying external surface pressure thereto.

Closure and extrusion fitment 29 includes a substantially frusto-conical raised central portion 97 that extends at its base into an annular flange of generally U-shaped configuration including the inner face 77 and its free peripheral edge 60. The raised central portion 97 includes an extrusion orifice 103 which is closed by a removable cover 104. When the product, such as soft ice cream, that is sealed within the package assembly is to be dispensed by the consumer, the cover 104 is removed to expose the extrusion orifice 103, whereby the soft ice cream or the like is dispensed or extruded through the orifice 103 by manually applying external surface pressure or squeezing action to the container 27.

From the foregoing, it is readily apparent that the invention provides a novel and relatively uncomplicated apparatus and method for filling and sealing packaging assemblies for flowable products such as soft ice cream or the like.

While there has been shown and described what are considered to be preferred or suitable embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. In a packaging apparatus including conveyor means for intermittently transporting containers along a generally horizontal path in an upright position to a plurality of processing stations for filing said containers with a flowable product, and thereafter closing and sealing the containers, comprising:

(a) means for dispensing open-ended containers in sequence from a nested stack of said containers at a first station such that said containers are dropped onto the conveyor and carried therealong supported in said upright position;

(b) filling means at a second station for filling each of the conveyed containers on said conveyor with a requisite quantity of flowable product;

(c) insertion means at a third station for seating a preshaped closure fitment within the open end of one of the filled containers on the conveyor to thereby define a lip portion of the filled container that extends beyond a peripheral edge of said closure fitment;

(d) means at a fourth station for interengaging each of said closure fitments and the container within which each said fitment is seated to form a closed container structure, said interengaging means including crimping means which further includes crimping segments and means to inwardly and downwardly move said crimping segments to fold the container lip portion inwardly and downwardly over the peripheral edge of the closure fitment and onto an inner face of the closure fitment to form said closed container structure; and (e) sealing means for sealing the folded lip portion of each container to the inner face of each of the closure fitments to produce filled and sealed packages, said filled and sealed packages being conveyed to a discharge end of the apparatus on said conveyor.

2. An apparatus as claimed in claim 1, wherein said container dispensing means comprises support means for orienting said nested stacks of containers in vertical columns; means engaging the outer surface of the lowermost container in each stack for separating said container from the stack in synchronism with the advancing movement of the conveyor and permitting the separated container to drop into a support on said conveyor.

3. An apparatus as claimed in claim 2, wherein said container surface engaging means comprises pivotable finger members having container-contacting surfaces for biasing said container downwardly towards said conveyor.

4. An apparatus as claimed in claim 3, comprising a plurality of said pivotable finger members being arranged on diammetrically opposite sides of said container.

5. An apparatus as claimed in claim 4, comprising guide pins on said dispensing means contacting the outer surface of said container at points about the circumference of said container for supporting said container circumference in four quadrants during separation from said nested stack of containers.

6. An apparatus as claimed in claim 3, wherein the container-contacting surfaces of said finger members are made of a generally high-friction material.

7. An apparatus as claimed in claim 1, wherein said filling means includes a product filler valve connected to a product supply source, depending nozzle means on said filler valve adapted to be lowered onto said containers on said conveyor for filling product into said containers.

8. An apparatus as claimed in claim 7, including means for raising said nozzle means during the filling of said product into the container; and a piston reciprocable within said filler valve for closing off the nozzle means upon a predetermined quantity of product having been filled into each said container.

9. An apparatus as claimed in claim 1, wherein said crimping means has radially openable and closeable arcuate crimping segments; and said interengaging means includes means for vertically reciprocating said crimping means and causing the crimping segments to open so as to encompass the lip portion of the container; means for closing the crimping segments to bend the lip portion of the container radially inwardly over the peripheral edge of the closure fitment; means for moving the crimping means downwardly so as to form the closed container structure; and means for retracting the crimping means from said closed container structure.

10. An apparatus as claimed in claim 9, wherein said means for actuating said crimping means comprises coacting cam and cam follower means operating in synchronism with the advance of the containers on said conveyor.

11. An apparatus as claimed in claim 1, wherein said sealing means comprises a vertically displaceable heat sealer head connected to a source of electrical current for heating said head; annular sealing lip on said sealer head adapted to contact the crimped portions of each said interengaged closure fitment and container for heat sealing the contacting surfaces thereof and to form a sealed, substantially fluid-tight container structure.

12. An apparatus as claimed in claim 11, wherein said sealer head includes spring-biased plate means for ejecting closure fitments from the sealer head.

13. An apparatus as claimed in claim 1, comprising means at the discharge end of the conveyor aiding in the discharge of sealed containers from said apparatus.

14. An apparatus as claimed in claim 13, wherein said means comprises a reciprocable plate member adapted to exert an outwardly displacing force to the bottoms of the containers.

15. An apparatus as claimed in claim 1, wherein said crimping means includes crimping segments that are mounted for pivotal movement in response to sliding movement between a sleeve and a shaft of said interengaging means, such pivotal movement being between an open configuration and a closed configuration of said crimping segments, said open configuration defining a combined periphery of the crimping segments that accommodates engagement with the outer surface of the lip portion of the container; said closed configuration of the crimping segments defining a combined periphery that approximates the shape and size of the inner face of each closure fitment, and said interengaging means further includes means for vertically moving the crimping segments when said crimping segments are in their closed orientation.

16. An apparatus as claimed in claim 1, wherein said crimping means includes crimping segments that are mounted for pivotal movement between a sleeve and a shaft of said interengaging means, each said crimping segment being pivotally mounted to said sleeve and being in operative engagement with said shaft whereby relative sliding movement between said sleeve and said shaft moves said crimping segments between an open configuration and a closed configuration, and said interengaging means includes means for vertically moving said crimping segments without pivoting same between said open and closed configurations.

17. An apparatus as claimed in claim 1, wherein said interengaging means includes downwardly biased plunger means for assisting in the proper seating of each fitment within each filled container at said fourth station.

18. A method of forming closed container structures including intermittently transporting the containers on a conveyor along a generally horizontal path in an upright position past a plurality of processing stations for filling said containers with a flowable product, and thereafter closing and sealing the containers, comprising:

(a) dispensing the containers in sequence from a nested stack of said containers at a first station and dropping said containers onto the conveyor for conveyance therealong while supported in said upright position;

(b) filling said containers at a second station with a requisite quantity of flowable product, said filing being through an opneing of each container;

(c) seating a preshaped closure fitment within the opening of each of the filled containers on the conveyor to thereby define a lip portion of each filled container that extends beyond a peripheral edge of said closure fitment;

(d) interengaging said closure fitments and the respective containers on which said fitments are seated at a fourth station to form a closed container structure, said interengaging including a crimping procedure comprising inwardly and downwardly folding the container lip portion over the peripheral edge of the closure fitment and onto an inner face of the closure fitment by inwardly and downwardly moving crimping segments to form said closed container structure; and (e) sealing the folded lip portion of each container to the inner face of each of the closure fitments to produce sealed container, and conveying said sealed containers to a discharge end of the apparatus.

19. A method as claimed in claim 18 wherein dispensing said containers includes orienting said nested stacks of containers in vertical columns; engaging the outer surface of the lowermost container in each stack to separate said container from the stack in synchronism with the advancing movement from the conveyor, and dropping the separated container into a support on said conveyor.

20. A method as claimed in claim 19, including engaging said container surface with pivotable finger members for biasing said container downwardly towards said conveyor.

21. A method as claimed in claim 18, including filling said containers with a product filler valve connected to a product supply source, and lowering depending nozzle means on said filler valve into said containers on said conveyor for filling product into said containers.

22. A method as claimed in claim 21, including raising said nozzle means during the filling of said product into the containers; and reciprocating a piston within said filler valve for closing off the nozzle means when a predetermined quantity of product has been filled into each said container.

23. A method as claimed in claim 18, including interengaging said closure fitment and container through crimping means having radially openable and closeable arcuate crimping sections; vertically reciprocating said crimping means and causing the crimping sections to open so as to encompass the outer surface of the container circumference; closing the crimping sections to bend the lip of the container radially inwardly over a free external peripheral edge of the closure fitment; moving the crimping means downwardly so as to crimp the lip of the container over the material of the closure fitment edge to form an interengaged closed container structure; and retracting the crimping means from said container structure.

24. A method as claimed in claim 18, including effecting said sealing with a vertically displaceable heat sealer head connected to a source of electrical current for heating said head, contacting a bottom annular sealing lip on said sealing head with the crimped portions of each said interengaged closure fitment and container for heat sealing the contacting surfaces thereof so as to form a sealed, substantially fluid-tight container structure.

25. A method as claimed in claim 18, including exerting force on the containers at the discharge end of the conveyor aiding in the discharge of sealed containers from the apparatus.

26. A method as claimed in claim 18, wherein said crimping procedure includes pivotally moving crimping segments to an open configuration into engagement with the outer surface of the lip portion of the container, pivotally moving the crimping segments to a closed configuration to thereby fold the lip portion inwardly over the peripheral edge of the closure, and moving the crimping segments downwardly so as to crimp the lip portion over the inner face of the closure fitment to form said closed container structure.

27. A method as claimed in claim 18, wherein said interengaging at the fourth station includes engaging each closure fitment with a biased plunger member to assure that each closure fitment is properly seated in a substantially horizontal position within the filled container.

* * * * *